United States Patent [19]

Salzman et al.

[11] Patent Number: 4,722,608

[45] Date of Patent: Feb. 2, 1988

[54] MIXING APPARATUS

[75] Inventors: Ronald N. Salzman; Keith T. McDermott, both of Rochester, N.Y.

[73] Assignee: General Signal Corp., Rochester, N.Y.

[21] Appl. No.: 760,370

[22] Filed: Jul. 30, 1985

[51] Int. Cl.[4] ..... B01F 7/00

[52] U.S. Cl. ..... 366/330; 366/270; 366/279; 366/343; 416/228; 416/244 R

[58] Field of Search ..... 366/279, 330, 342, 325, 366/349, 343, 270; 416/231 B, 235, 228, 244 R

[56] References Cited

U.S. PATENT DOCUMENTS

| | | | |
|---|---|---|---|
| 1,192,111 | 7/1916 | Pitter . | |
| 1,422,109 | 7/1922 | Lambert | 416/235 |
| 2,014,032 | 9/1935 | Sharpe . | |
| 2,160,467 | 5/1939 | Ward . | |
| 2,193,686 | 3/1940 | Craddock | 416/228 |
| 2,396,811 | 3/1946 | Bathras . | |
| 2,485,827 | 10/1949 | Hartzell . | |
| 2,530,858 | 11/1956 | Cerniak . | |
| 2,859,936 | 11/1958 | Warnken . | |
| 2,869,840 | 1/1959 | Schmidt . | |
| 2,905,452 | 9/1959 | Appleton . | |
| 2,937,805 | 5/1960 | Warnken . | |
| 2,974,502 | 3/1961 | Radcliffe | 416/244 |
| 3,053,325 | 9/1962 | Ferreira . | |
| 3,117,630 | 1/1964 | Barish . | |
| 3,171,495 | 3/1965 | Puckett . | |
| 3,487,879 | 1/1970 | McCarthy . | |
| 3,533,714 | 10/1970 | Pfleiderer . | |
| 3,754,840 | 8/1973 | Zincone . | |
| 4,077,741 | 3/1978 | Lowson . | |
| 4,264,215 | 4/1981 | Nunlist et al. | 366/279 |
| 4,324,530 | 4/1982 | Fradenburgh . | |
| 4,365,897 | 12/1982 | Amorese et al. | 366/343 |
| 4,519,715 | 5/1985 | Golobic et al. | 366/343 |
| 4,544,281 | 10/1985 | Wilkinson | 366/343 X |

*Primary Examiner*—Timothy F. Simone

*Attorney, Agent, or Firm*—Martin LuKacher; J. S. Mednick

[57] ABSTRACT

Apparatus for mixing liquid and liquid suspension mediums in vessels with a mixing impeller shaft system of a composite of fibrous and plastic material of a structural configuration to enable the use of such material in commercial and industrial applications where the reaction loads of the medium on the system militate against the use of composite fibrous and plastic material. The system utilizes impellers having blades which distribute the reaction load through a hub on a mounting area of a shaft with keys and keyways in a manner to avoid stress risers unamicable to the composite material and which can cause failure thereof. Separate keys and keyways are provided to oppose the thrust due to the reaction loads and to oppose the torque due to such loads. Plural thrust keyways may be used to enable the impeller to be located at different positions on the shaft and at selected heights above the floor of the mixing vessel. Proplets on the tips of the blades extend entirely in the direction of the low pressure surface of the blades to control the flow field in the vessel and provide a more axial velocity profile of the inlet flow to the impeller which is nearly axial and substantially reduces the strength of the tip vortices.

68 Claims, 19 Drawing Figures

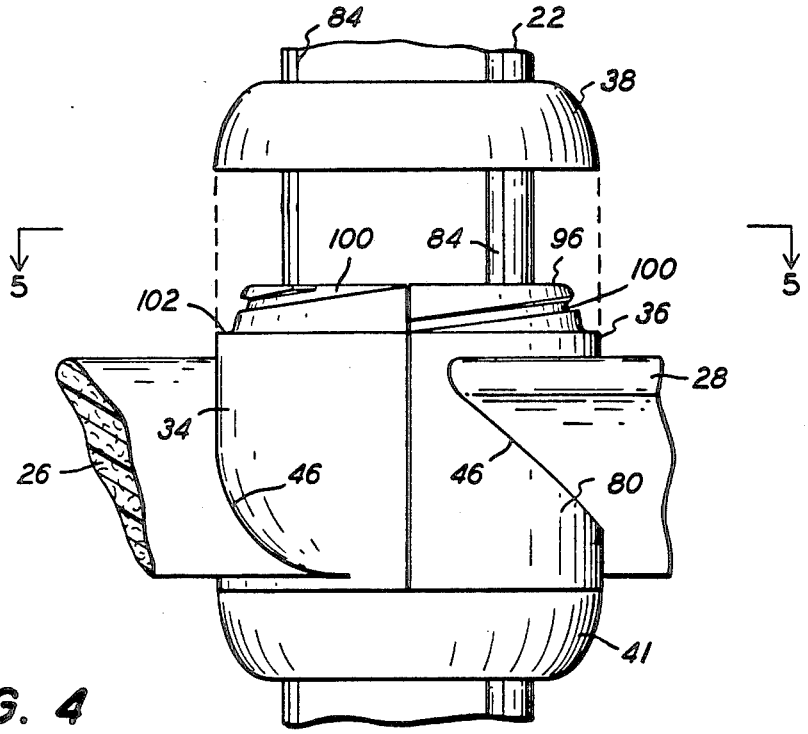
FIG. 4
FIG. 5
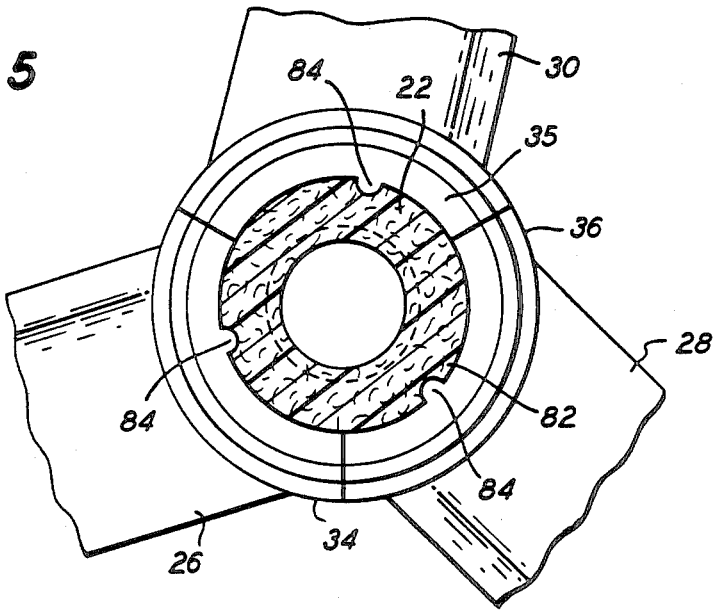

MIXING APPARATUS

DESCRIPTION

The present invention relates to mixing apparatus, and particularly to apparatus for the mixing of liquid mediums and liquid suspension mediums, which may include solids and gases, which mediums are contained in vessels, such as mixing tanks.

It is the principal feature of the invention to provide mixing apparatus for commercial and industrial applications, such as chemical processes, wherein blending liquids, mixing of solid suspensions, emulsification, aeration, as well as other industrial and commercial mixing operations are carried out and wherein the mixing system in the tank uses an impeller of a composite of fibrous and plastic material, which may also be called fiber-reinforced plastic (FRP).

Although various articles, such as pipes, boathulls, tanks and aircraft propellers, have been constructed of fiber-reinforced plastic to take advantage of the light weight and chemical resistance of such materials, practical and effective mixing apparatus for commercial and industrial applications has not heretofore been satisfactorily provided which is capable of benefiting from the desirable properties of such composite materials. Composite materials do not have the structural properties which are amenable to the reaction loads on mixing impeller systems. For example, composite materials when overstressed enter a failure mode. Overstressing can result from any concentrated point loads on the structure. In the case of metals (the conventional impeller material) such point loads are accommodated by localized strain hardening. Composite materials do not react to point loads by hardening, but simply fail.

The problem has been attacked, in accordance with the invention, in several mutually complementary ways. It has been discovered that with certain impeller blade configurations, and with the use of certain hubs, shaft configurations and means for assembling the impeller on the shaft, the reaction loads on the impeller to the shaft are distributed in a manner to avoid stress risers which can initiate failure modes. It has also been discovered that the flow field can be made essentially axial and with greatly reduced tip vortices, which corresponds to higher pumping efficiencies, because of the blade configuration and by incorporating effectively certain proplets on the blades. Through the use of this newly discovered impeller system configuration and with the arrangement of the fibrous material, which forms the core of the composite, the strength and rigidity of the impeller system is enhanced. The totality of the improved structural characteristics, flow control characteristics and structural properties due to the design of the fiber core, enables the satisfactory implementation of commercial and industrial mixing apparatus with a composite of fibrous and plastic material. The mixing apparatus can then benefit from the properties of such material, such as their light weight. This enables the impeller to be rotated at higher speeds, or alternatively at the same speed with a substantially longer shaft, than a metal shaft and impeller, without reaching shaft critical speed. The mixing process can then be carried out in less time and with higher efficiency than with metal impellers of equivalent capacity, thereby reducing processing costs.

It is therefore the principal object of the present invention to provide improved mixing apparatus wherein the impeller system is fabricated of composite fibrous plastic material.

It is a still further object of the present invention to provide improved mixing apparatus having impellers which distribute the reaction loads over the impeller and from the impeller to the shaft in a manner to avoid stress risers which can cause failure modes in a composite of fibrous and plastic material when the impeller system is constructed therefrom.

It is a still further object of the present invention to provide improved mixing apparatus, suitable for commercial and industrial mixing processes, which is constructed principally of composite fibrous and plastic materials such as fiber-reinforced plastics and by molding fibrous and plastic resins.

Briefly described, apparatus for mixing liquids or liquid suspension mediums contained in a vessel, which embodies the invention, uses an impeller system having a shaft of a composite of fibrous and plastic material and an impeller having a hub and the plurality of blades, also of composite fibrous plastic material. The blades extend from bases thereof which are disposed at the hub to tips at the outer ends of the blades. The impeller may be of a diameter suitable for use in industrial and commercial mixing processes. The blades have a stiffness increasing from the tips to their bases for counteracting flexure due to reaction loads of the medium against the blades as the impeller rotates. The blades are preferably of air foil shape with camber, twist (geometric chord angle variation), and thickness, with the thickness and the geometric angle decreasing over substantial portion of the blades in the radial direction towards the tips thereof. The hub is disposed on a mounting area of the shaft. Means are provided for assembling the hub to the shaft and locking the hub to the shaft against thrust in a direction axially of the shaft and torques in a direction around the shaft due to the reaction loads, while distributing the thrust and torque over the mounting area in a manner to avoid stress risers which can give rise to failure modes of the composite material. In order to control the flow field, the blades, which have high and low pressure surfaces on opposite sides thereof, are provided with proplets which extend entirely above the low pressure surface. These proplets control the flow field so as to insure that the impeller inlet flow in the mixing vessel is essentially axial and therefore develops reaction loads which are generally uniformly distributed over the impeller blades. The proplets also counteract vortices in the flow at the tips further which reduces the wasted energy required to pump the fluid.

The foregoing and other objects, features and advantages of the invention as well as a presently preferred embodiment thereof, will become more apparent from a reading of the following description in connection with the accompanying drawings in which:

FIG. 4 is a fragmentary view, in elevation, illustrating the impeller hub and blades extending therefrom mounted on the shaft;

FIG. 5 is a sectional plan view, the section being taken along the line 5—5 in FIG. 4;

Figure 1:
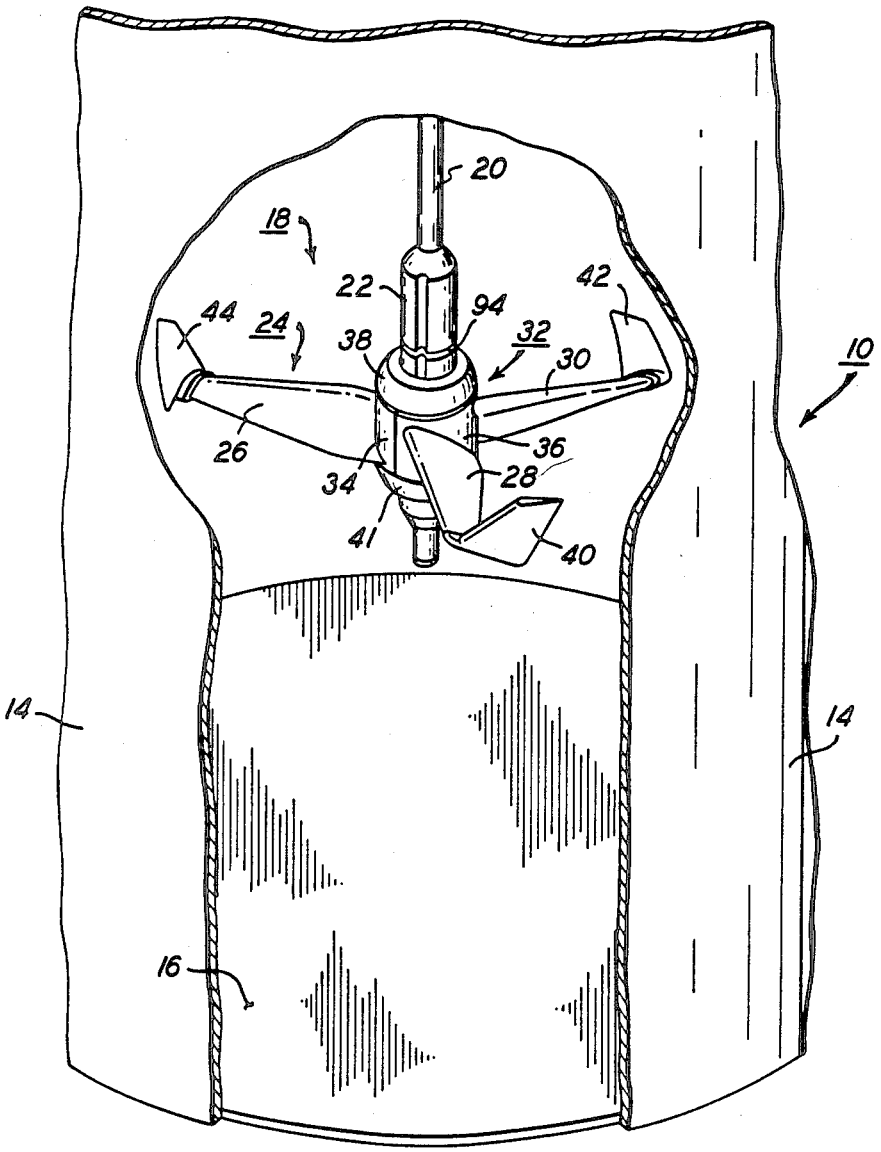
FIG. 1 is a perspective view of mixing apparatus embodying the invention contained in a tank, which is partially broken away to show the impeller and a portion of the shaft of the apparatus.
Figure 1A:
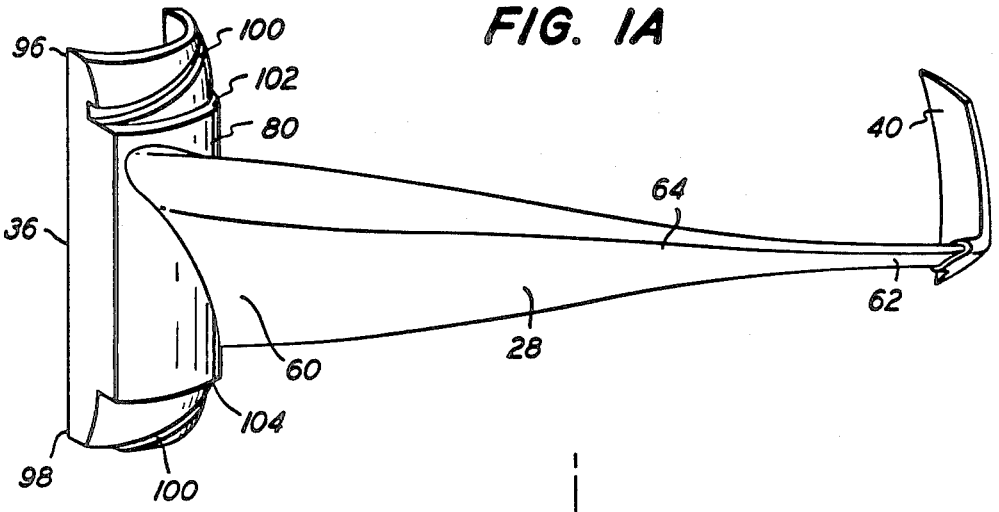
FIG. 1A is a perspective view of one of the blades of the impeller illustrated in FIG. 1.
Figure 2A:
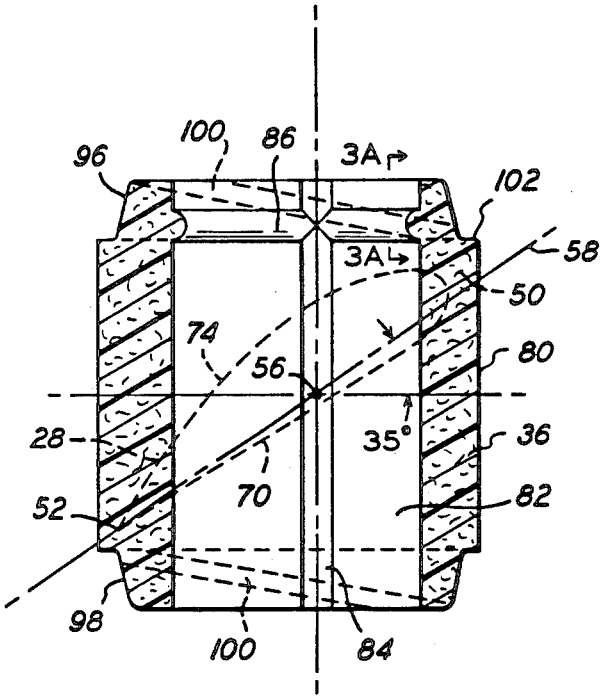
FIG. 2A is an end view of the hub section illustrated in FIGS. 2 and 3 viewed from the right in FIG. 2.
Figure 3A:
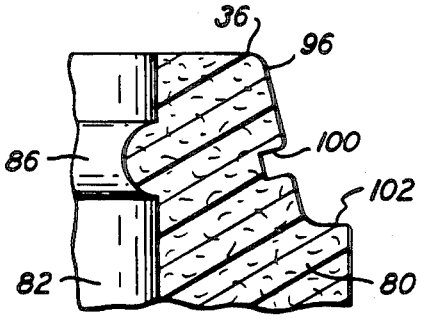
FIG. 3A is an enlarged, fragmentary, sectional view of a portion of the hub of the section illustrated in FIG. 2, 2A and 3, taken along the line 3A—3A in FIG. 2A.
Figure 2:
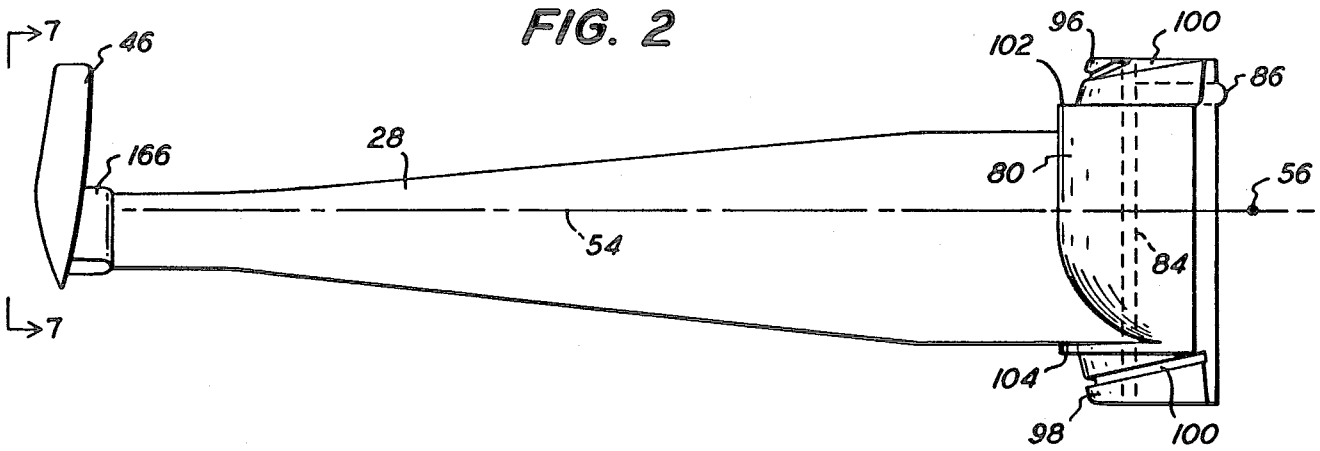
FIG. 2 is a rear view of one section of the impeller including the blade, the hub and the proplet thereof as viewed from the rear, i.e., facing the trailing edge of the blade.
Figure 3:
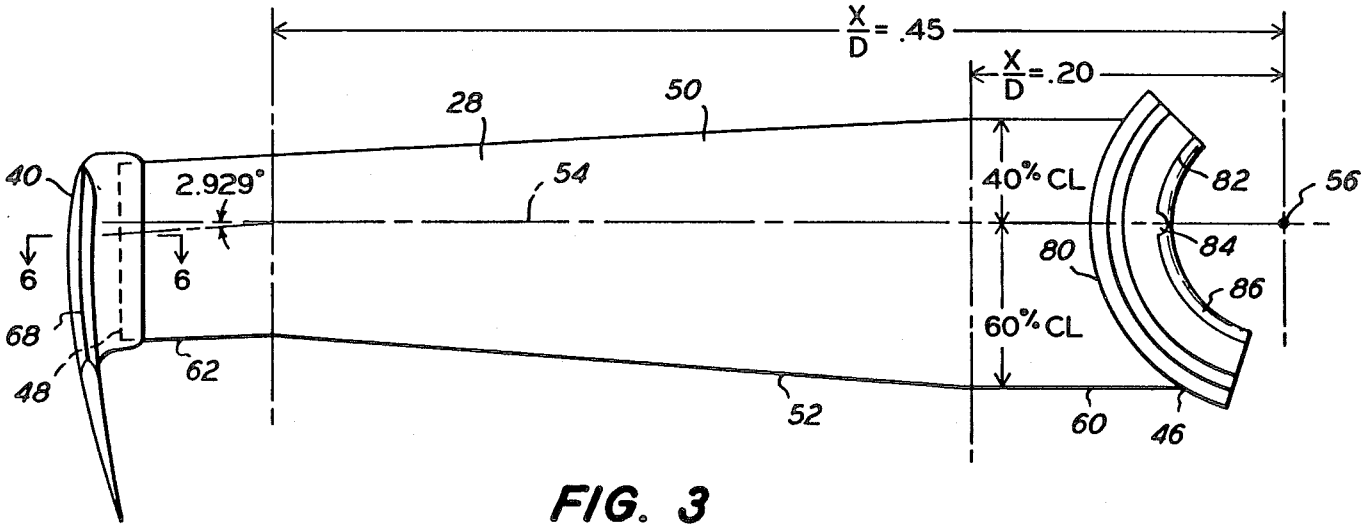
FIG. 3 is a plan view of the blade illustrated in FIG. 2.
Figure 8:
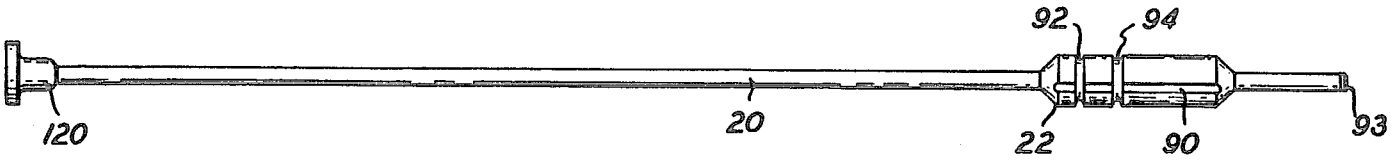
Figure 7:
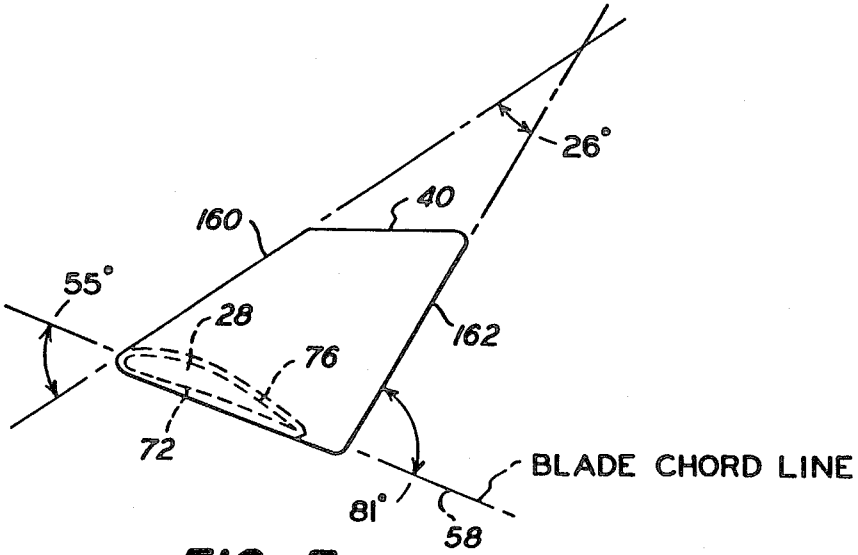
Figure 6:
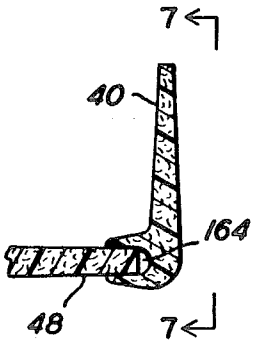
FIG. 6 is a fragmentary view of the tip portion and proplet of the impeller shown in FIGS. 2 and 3, the view being taken along the line 6—6 in FIG. 3.
Figure 9:
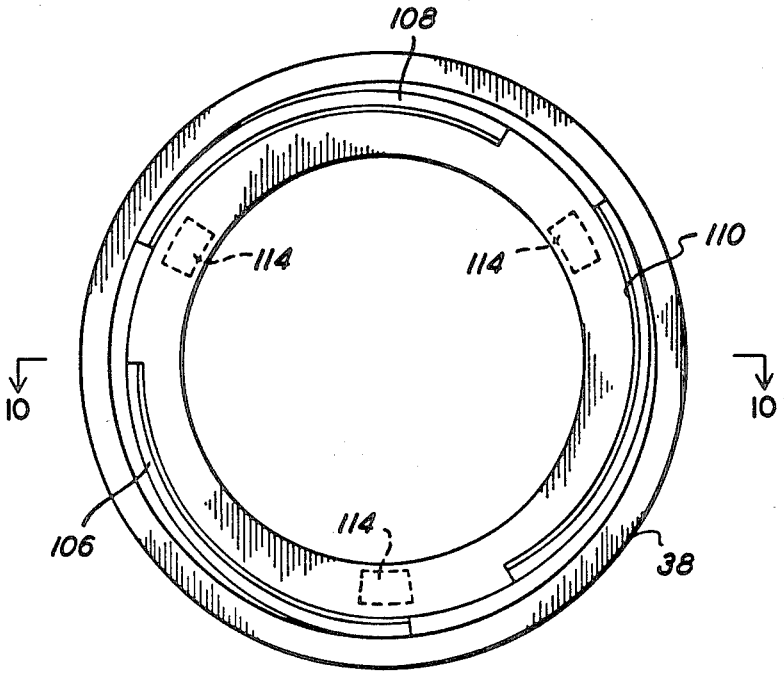
Figure 10:
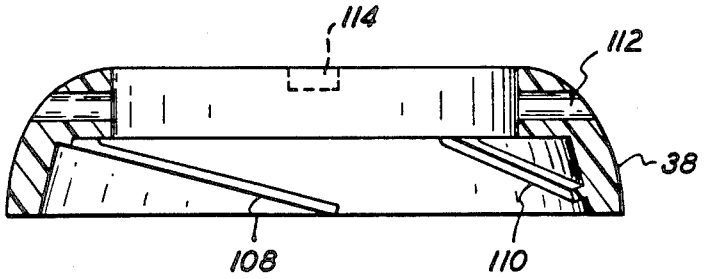
Figure 11:
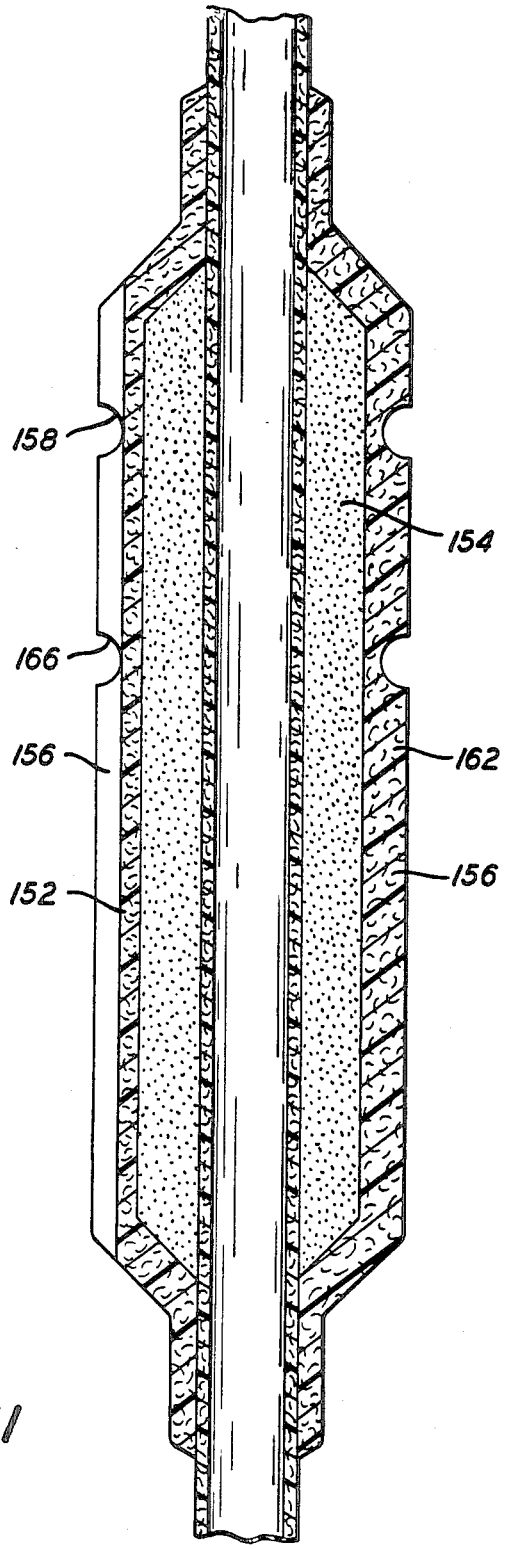
Figure 12:
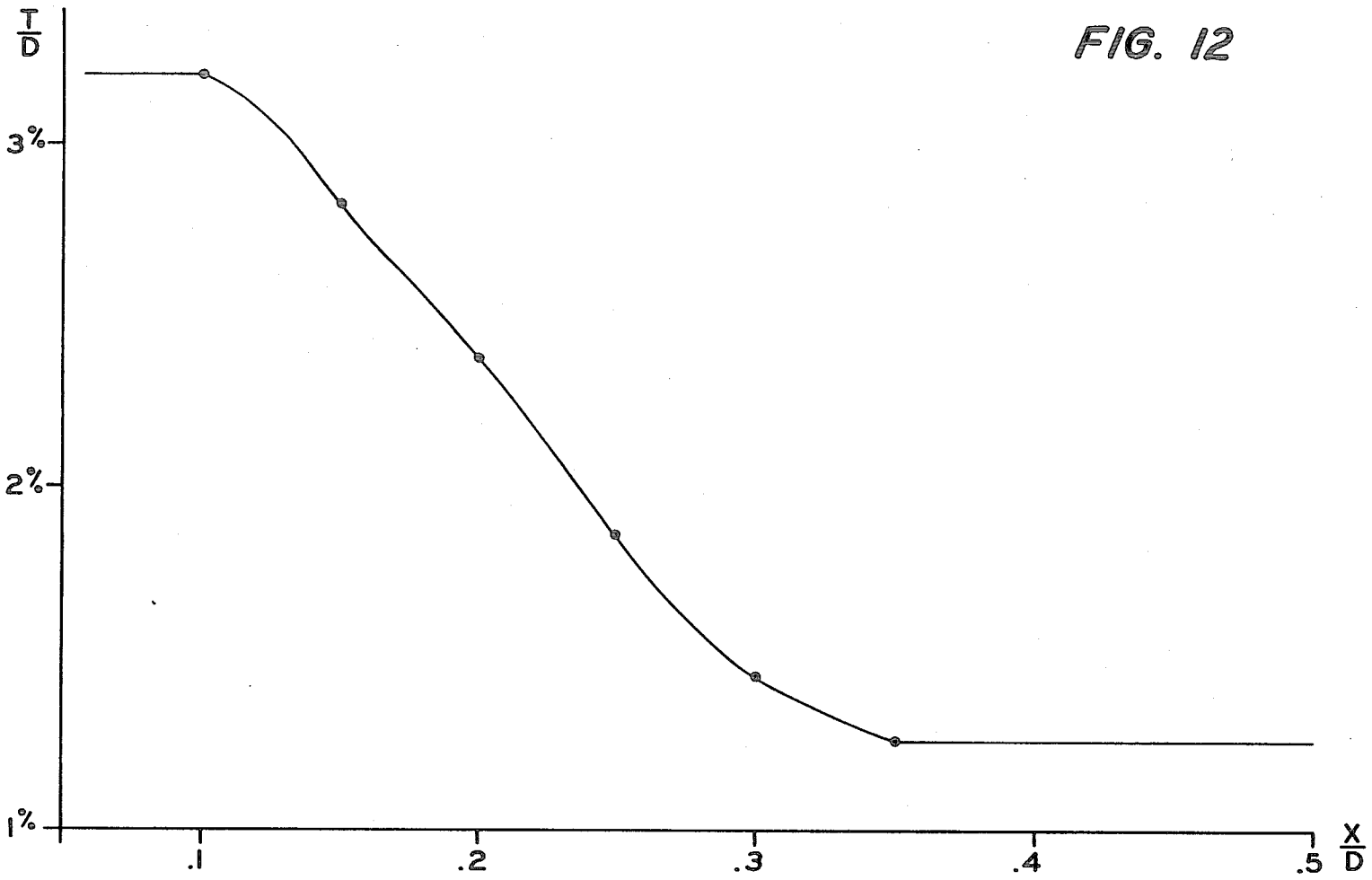
Figure 13:
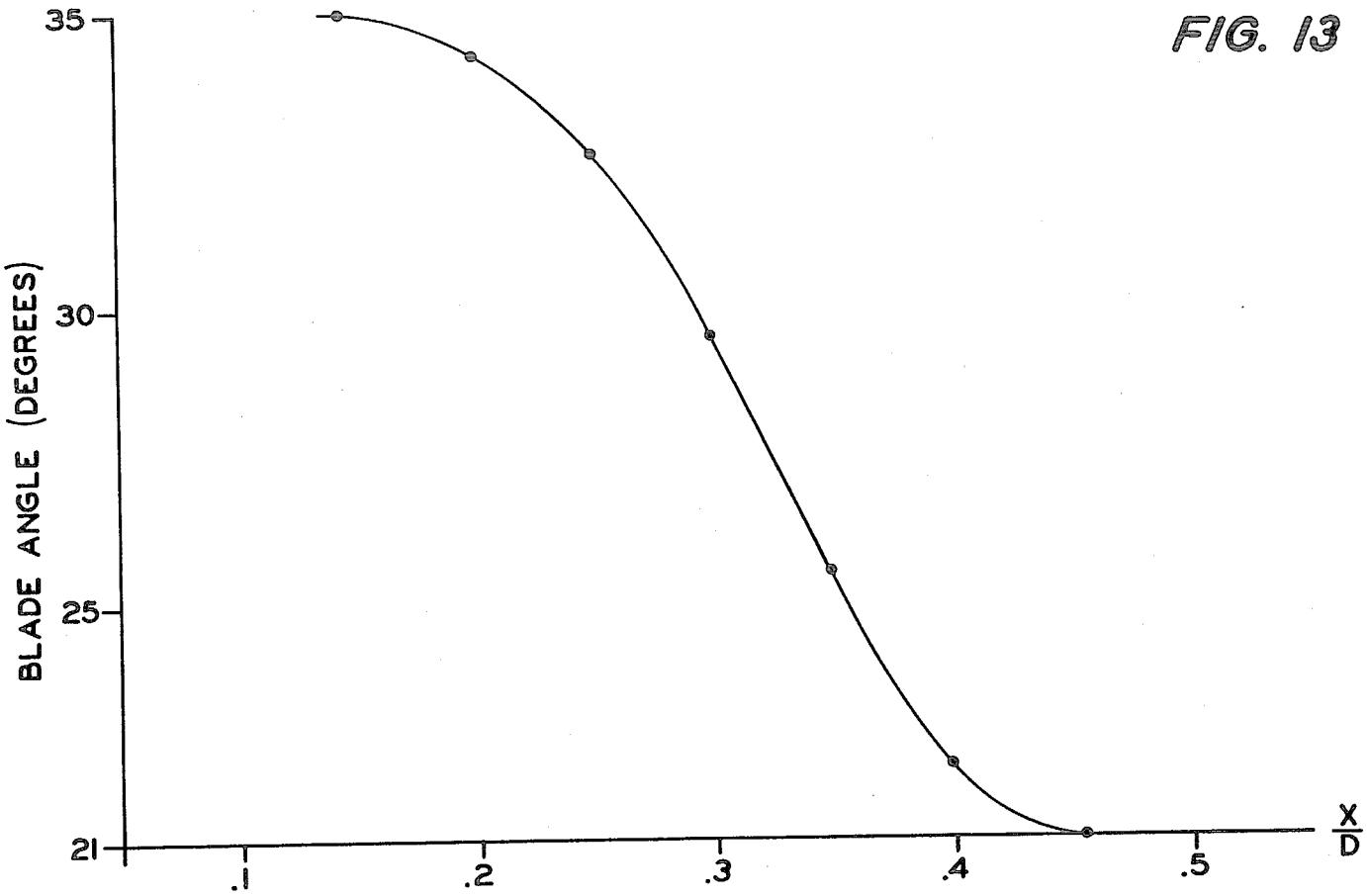
Figure 14:
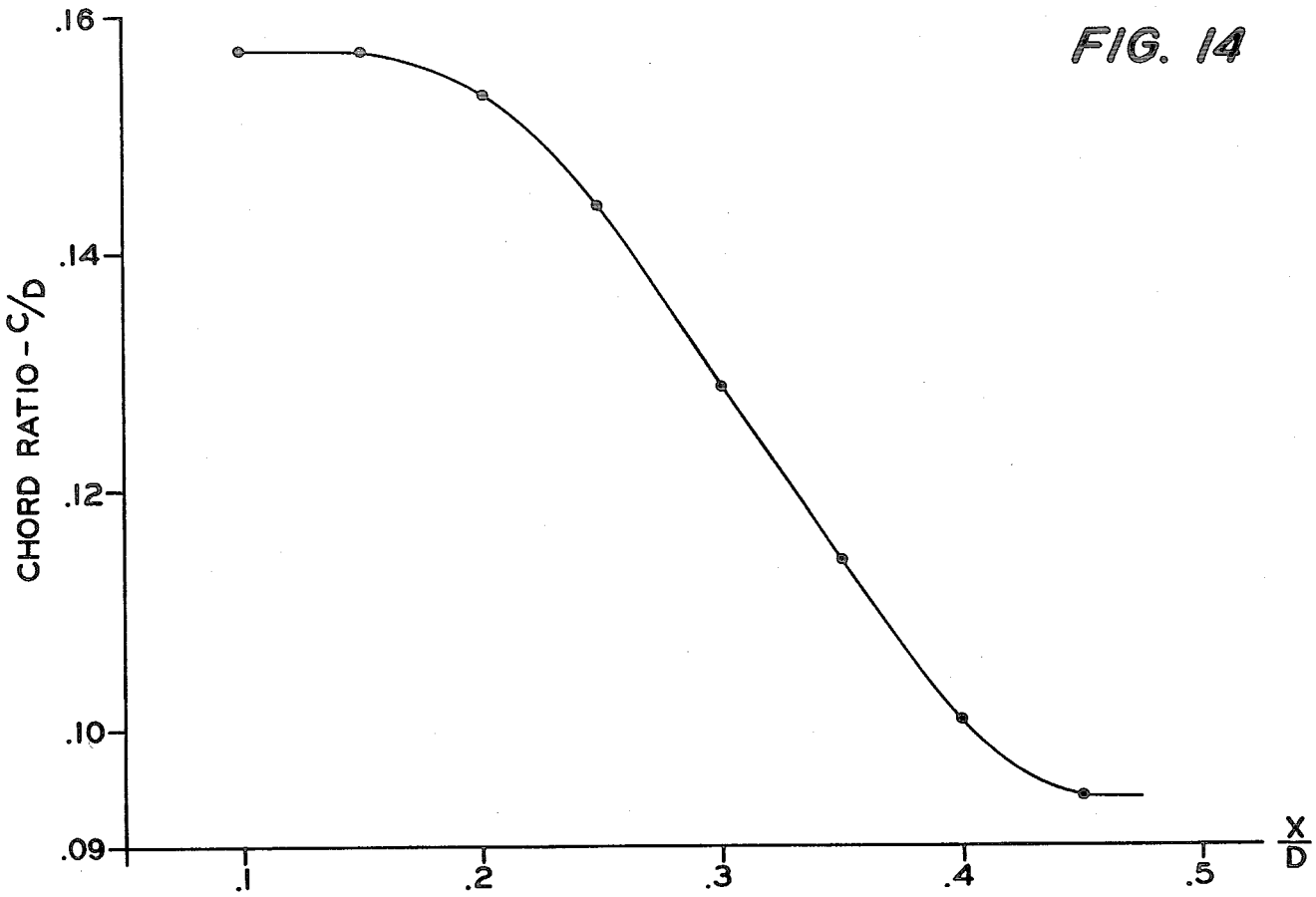

FIG. 7 is an end view of the impeller section shown in FIGS. 2 and 3, the view being taken along the line 7—7 in FIG. 2 and in FIG. 6 when viewed in the direction of the arrows at the ends of line 7—7;

FIG. 8 is a elevational view of the shaft shown in FIG. 1;

FIG. 9 is a plan view of one of the hub rings which provide in part the means for mounting the hubs on the shaft;

FIG. 10 is a sectional view of the hub ring illustrated in FIG. 9 taken along the line 10—10 in FIG. 9;

FIG. 11 is a fragmentary sectional view of a portion of a shaft and the area thereof on which the impeller may be mounted, in accordance with another embodiment of the invention;

FIGS. 12, 13 and 14 are graphs illustrating presently preferred variations in thickness, width and twist of the blades of the impeller illustrated in FIGS. 1, 1A, 2 and 3.

Referring to FIG. 1, there is shown a vessel, which may be a tank 10 having side walls 14 and a bottom 16. The tank may be open at the top or closed. The tank is filled with a liquid or liquid suspension medium, depending upon the process in which mixing is used. Mixing of the medium in the tank is carried out with an impeller system 18. This system includes a shaft 20 which is driven by a suitable motor through a transmission (gear drive) so as to set or control the speed of rotation of the shaft 20 depending upon the mixing process. The shaft has a built up mounting area 22 on which an impeller 24 is assembled and mounted. The impeller has three blades 26, 28, and 30 and a hub 32 which assembles and locks the blades to the mounting area 22 of the shaft 20. The hub has three sections 34, 35 and 36, one for each of the blades. Two of these sections 34 and 36 are illustrated in FIG. 1. Hub rings 38 and 41 threadingly engage the hub sections and clamp them against the mounting area 22 of the shaft 20. The tips of the blades have proplets 40, 42, and 44 attached thereto.

The shaft 20, its mounting area 22 and the impeller 24 including the blades 26, 28, and 30, the hub 32 and the proplets 40, 42, and 44 are all made of a composite of fibrous and plastic material, also called fiber-reinforced plastic (FRP). Compression molding or resin transfer molding may be used to construct the impeller 24 and the built up mounting area 22. The use of FRP provides a substantial reduction in weight of the impeller system as compared to conventional impeller systems, which are made from metal. The lighter weight affords higher speeds of the system 18 before critical speed is reached, thereby allowing the use of a higher speed lower torque (lighter and less expensive) geardrive or other transmission. The lighter weight shaft and impeller make it possible to have longer shaft lengths, a significant advantage for tall tanks and other vessels.

All of these advantages are obtained in accordance with the invention because of the construction which enables composite materials to be used in spite of their structural properties. While the ultimate strength and corrosion (chemical) resistance of such materials is high, and comparable or even better in some respects than metals, their structurial rigidity is low. They also are subject to accelerated chemical attacks and failure modes when overstressed, particularly by localized loads. Such overstressing causes stress rises in localized regions which spread, causing cracking and failure.

The loading on the impeller system 18 is controlled, in accordance with the invention, with the configuration of the blades 26, 28, and 30, the configuration of the hubs which distributes the reaction loads to the shaft, the enlarged mounting area 22 of the shaft, and the interior structural configuration of the blades, hubs, proplets, shaft, and shaft mounting area. The proplets 40, 42 and 44 assist by controlling the flow field.

A typical blade 28 of the blades (which are identical) is illustrated in FIGS. 1A, 2, 2A, and 3. The blade 28 extends from its base 46 at the hub section 36 to its tip 48 from (see also FIG. 6). The blade has a leading edge 50 and a trailing edge 52. A line 54 extending radially from the center 56 of the shaft is the blade axis where the reaction load on the blade as the impeller rotates is, approximately, located. This line is located, as measured along the chord (the line 58 between the intersection of the mean line through the blade cross section and the leading and trailing edges 50 and 52 thereof (see FIG. 2A) at 40% of the chord length from the leading edge 50 and 60% of the chord length from the trailing edge 52.

The blade 28 is an air foil having constant camber. The width of the blade (the length between the tip and leading edge along the chord decreases from the base 46 to the tip 48 over a substantial portion of the blade which is the portion illustrated in FIG. 3 between the base portion 60 which ends at the point along the blade axis 54 a distance equal to $X/D=0.2$, and the beginning of the tip portion 62 which begins at a distance along the blade axis 54 equal to $X/D=0.45$. This substantial portion is designated by the reference number 64. In the foregoing X/D expressions, D is the diameter of the impeller and is twice the distance measured along the blade axis to the mean line 68 of the proplet 40 from the center 56 of the shaft. The distance X depends upon the impeller diameter D. Impellers in accordance with the invention may be very large as to be adapted for industrial and commercial applications. For example the impellers may vary from diameters of two feet to ten feet. The blade 26 also has twist which may be measured as the angle between the chord 58 and a plane perpendicular to the axis of the shaft. The twist is invariant substantially throughout the base portion 60 and in the tip portion 62. The twist decreases in the direction from the base to the tip (outwardly of the impeller blade) through the substantial portion 64 thereof.

FIGS. 12, 13, and 14, respectively, show the presently preferred variation in thickness, twist and width. It will be noted that there are no sharp variations between the base portion 60 and the substantial intermediate portion 64 and between the intermediate portion 64 and the tip portion 62 so as to provide a smooth surface. Thus, the thickness variation extends back into the base portion to a position where X/D equals approximately 0.1. The thickness of the blades varies over the substantial portion, ranging from 3.2% near the hub down to 1.26% at the tip, where the percentage is equal to T/D (the thickness ratio) where T is the thickness and D is the impeller diameter. Similarly, the width variation begins at approximately X/D=0.15. The width of the blade varies from 15.5% near the hub down to 9.5% at the tip, in terms of the chord length to impeller diameter ratio (C/D). It will be observed that the twist varies approximately 13° over the substantial intermediate portion 64. For a family of impellers the blade angle and chord length ratio distributions can remain very similar for all diameter impellers. The blade thickness ratio can be adjusted, based on design loads and allowable flexure. The thickness ratio may increase by a factor of two for extreme cases; e.g., very large diameter impellers.

It will be noted that the leading edge 50 of the blade is swept back slightly (about 4.5°) over the substantial intermediate portion 64 and the tip portion 62, while being approximately parallel to the blade axis 54 over the base portion 60. The trailing edge 52 is swept forward over the substantial intermediate portion 64 and is swept back slightly (4.5° with respect to the blade axis 54) over the tip portion 62. The sweep back maintains the blade axis at the 40% and 60% location as shown in FIG. 3. The trailing edge is substantially parallel to the blade axis 54 over the base portion 60.

This structural configuration provides for an increasing stiffness of the blade between the tip 48 and the base 46 thereof. This increasing stiffness enhances the resistance to flexure due to reaction loads. The stiffness of the composite material can range from 3 to 15% (a typical value is 6.7%) of the stiffness of steel (flexural modulus of 30,000,000 for steel as compared to 2,000,000 for composite material). Thus, the configuration is important in providing the stiffness characteristics which facilitates the distribution of the reaction loads and minimizes localized stress concentrations along the blade length and particularly at the hub-blade intersection.

The stiffness of the blade 28 is also enhanced by virtue of its internal construction. The blade 28 and its hub section 36 are molded as an integral unit preferably by compression molding or resin transfer molding. In resin transfer molding, a mold is constructed having the shape of the blade 28 and its hub section 36. The mold may have two parts. In one of these parts, there is laid up on the bottom thereof a veil of felted fiberglass strands. Such veils are thin and are commercially available. The veil is then backed with a mat containing chopped strands of fiberglass or fiberglass rovings which are woven into a mat. This or a similar construction constitutes the corrosion barrier. Then a plurality of structural layers, for example three layers which are composed principally of uniaxial continuous fiberglass strands, are laid so that the strands extend radially along the blade axis 54. The mats and uniaxial layers extend beyond the base portion of the blade and are then folded towards one end of the hub section. Another plurality of uniaxial fiberglass layers is used which are folded toward the opposite end of the hub section. To maintain the relationship between the second group of uniaxial layers and to prevent them from moving when the resin is injected into the mold, several layers of fibrous material, which may be biaxial layers or weaves, are inserted to fill the regions of the blades of increased thickness and also to fill the mold in the region which will form the hub section. The uniaxial layers which are folded upwardly and downwardly towards the opposite ends of the hub section are covered with additionial mats and a veil layer.

Sheets containing the uniaxial and biaxial fibers as well as the veils and other mats are available commercially. They are cut to size and are inserted in the mold. The mold is then closed and heated. A thermoset resin is then injected. The resin used may be epoxy, polyester or preferably vinyl ester resins with suitable additives (catalysts). Such resins are commerically available from the Dow Chemical Company of Midland, Mich. (their Derakane® vinyl ester resins) and from others. The fibrous material layers provide both a corrosion barrier and structural rigidity and strength in the composite blade and hub section. The resulting composite structure and the configuration of the blade and its hub is a rigid structure which can flex slightly under load, but does not flex significantly so as to give rise to excessive stress concentrations therein. The structure is sufficiently rigid when blade deflection is less than 1% of the impeller diameter at design load. The impeller structure may be fabricated by the use of the compression molding process. The process and construction described in detail herein is presently preferred.

Each of the hubs, including the hub 36, occupies a sector of a circle around the shaft mounting area which is preferably slightly less than 120°, for example 118°. It will be appreciated that the blades may be wider than shown in the drawing or narrower, occupying less or more than the sector of its hub. In the event that the blade is wider at the base it may taper slightly inwardly to meet the hub section thereof and to clear the edge of the blade adjacent thereto.

The blades have low pressure surfaces which are the top surfaces, convexly outwardly curved in the cross section. The blades also have high pressure surfaces which are opposite to the low pressure surfaces. The liquid or liquid suspension must travel a greater distance over the low pressure surface than the high pressure surface thereby creating lift and pumping forces on the medium. The blades, mounted as shown in FIG. 1, are down pumping; causing axial flow towards the bottom 16 of the tank 10. The high pressure surfaces are shown at 70 in FIG. 2A, and at 72 in FIG. 7. The low pressure surfaces are shown at 74 in FIG. 2A and 76 in FIG. 7. It will be appreciated that FIG. 2A illustrates the projection of the cross section of the base 46 of the blade while FIG. 7 shows the the projection of the cross section of the tip thereof. The principal forces on the impeller as it rotates are at an angle of 20° to 30° with respect to the shaft axis and act in the direction of the proplet. These forces are resolved into components of thrust (acting to lift the impeller) torque. Control of this flow, and resulting in improved efficiency of operation, has been found to depend, critically, upon the location of the proplets with respect to the pressure surfaces of the blades as will be discussed hereinafter.

Considering the hub section, reference may be made to FIGS. 2, 2A, 3, 4, and 5. There are three hub sections 34, 35, and 36 assembled and locked to the shaft mounting area 22. Each section has a central portion 80 which is along a sector of a hollow cylinder. The section has an interior surface 82, and an exterior surface on which the base 46 of the blade is mounted. In order to lock the hub sections on the shaft mounting area 22 against both torque and thrust due to the reaction load applied to the blades and to distribute the thrust and torque load to the shaft mounting area, areas are provided extending both axially and circumferentially from the interior surface. These areas on the hub sections are keys 84 and 86. These keys are semicircular in cross section so as to preclude the application of point loads and over stressing of the keys or the portion of the hub from which they project. The axial or vertical keys 84 oppose the torque loads and are referred to as torque keys. The horizontal and circumferential keys 86 oppose the thrust loads and are referred to as thrust keys.

The enlarged view of FIG. 3A further illustrates the cross section of these keys 84 and 86. The torque keys are located, as shown in FIG. 3, centered on the projection of the blade axis 53. The thrust keys 86 are deposed above the blade axis and preferably, as shown (FIG. 2A) above the low pressure surface 74 of the blades. The thrust keys are adjacent to the upper end of the hubs. When the hub sections are connected, the thrust keys 86 are along the same circle about the interior surface 82 of the hub sections. Since the thrust keys are above the blade axis the reaction load tends to force the key into, rather than out of, its cooperating thrust keyway on the mounting area. The keys distribute the reaction loads out over the mounting area 22.

The mounting area 22 as shown in FIG. 1 and also in FIG. 8 has a plurality of axial areas in the form of grooves which provide torque opposing keyways 90. The mounting area has one or more axially spaced areas in the form of grooves which provide thrust opposing keyways 92 and 94. The use of a plurality of thrust keyways enables the impeller 24 to be located at selected distances spaced for each other axially along the shaft, i.e., spaced from the bottom of the tank 16 (FIG. 1). The mounting area 22 may be enlarged and additional thrust keyways used if greater flexibility in the positioning of the impeller is needed. It will also be seen that the removability and replaceabilty of the hub sections with different sections enables the impeller to be changed without changing the shaft 20. Thus larger or smaller diameter impellers may be used to meet the needs of the particular mixing process which is to be carried out.

The hub rings 38 and 41 clamp the hub sections when screwed on to regions 96 and 98 at the opposite ends of the hub sections. Each of these end regions has a single female thread 100 which spirals across the end regions to steps 102 and 104 on opposite ends of the central area 80 of the hub section. The threads 100 on each of the opposite end areas 96 and 98 are of the same thread design, thus the caps are interchangeable between the top and bottom regions. The hub rings are also shown in FIGS. 9 and 10 which illustrate the upper hub ring 38. This hub ring is a ring having three male threads 106, 108, and 110. Each of these threads engages the female thread 100 on a different one of the hub sections 34, 35, and 36. The regions 96 and 98 and the inside surface of the hub rings, which are congruently tapered, permit a tight clamping force within the tolerances of the mounting area 22 diameter and the thickness of the hub sections. When the hub rings are screwed down, the tapered interface applies a compressive load between the ring and hub section which in turn clamps the hub to the shaft. The torque keys 86 and torque keyways 90 and the thrust key 84 and the selected thrust keyway 92 or 94 are seated in each other. Inasmuch as the load on the hub rings is merely the clamping load and any reaction loads applied thereto are minimal, the hub rings may not require any additional connection to the hub sections or mounting areas. However, it may be desirable to provide a hole, such as indicated at 112 in FIG. 10 through which a pin may be inserted into the hub section to prevent the threads from working loose.

The hub rings, like the blades and their hub sections are made of a composite of fibrous and plastic material. Layers of glass fiber sheets may be wrapped around (in a spiral) to define the structural core of the hub rings and placed in a mold where thermoset resin is injected and the hub rings fabricated by resin transfer molding as described in connection with the blades and hubs. Alternatively, compression molding of resin fiber compounds may be used. In order to facilitate the release of the hub rings from the mold, notches 114 may be provided for access by a spanner to rotate the hub rings and remove them from the mold, thereby releasing the threads from the mold.

The shaft 20 is preferably a tube with the enlarged mounting area 22; the mounting area being of greater diameter than the outer diameter of the shaft. The upper end of the shaft is connected by a fitting 120 (FIG. 8) to the impeller drive system, which may be the motors and transmission, such as the gear drive, (not shown) mounted at the top of the tank 10 (FIG. 1).

The shaft is preferably made of the same material as the impeller 24, i.e., fiber-reinforced epoxy, polyester or, preferably, vinyl ester. The shaft may be made by wrapping sheets of uniaxial fibers around a mandrel, after resin has been applied to the sheets. The axial orientation of the continuous fiber is preferred in order to maximize rigidity of the shaft in the axial direction. Several layers are used to build up the shaft. Filaments of glass fiber are helically wound round the mandrel over the glass fiber sheets. Multiple windings are used. The angle of the wrap may be a substantial angle, for example 50° to 70° to the shaft axis, in order to improve the torque transmission and enhance the hoop strength of the shaft. The shaft is then continued to be built up with layers of uniaxial fibers. The mounting area is further built up to the required diameter with resin impregnated fiberglass mat. The thrust and torque keyways 90, 92, and 94 may be machined into the mounting area after the resin cures. Alternatively, the mounting area may be molded onto a previously constructed shaft. Upon molding the thrust and torque keyways are formed in the mounting area.

It will be observed, especially in FIG. 2A and in FIG. 8 that the thrust and torque keys 86 and 84 form a cruciform on the interior surface 82 of each hub section. The intersecting thrust and torque keyways 92, 94, and 90 define a plurality of axially spaced cruciforms in the mounting area. These cruciform-shaped keys and keyways provide for distribution of the loads over the mounting area and preclude overstressing of the composite fibrous and plastic material from which hub sections 34, 35, and 36 and the mounting area 22 are constructed.

Figure 4A:
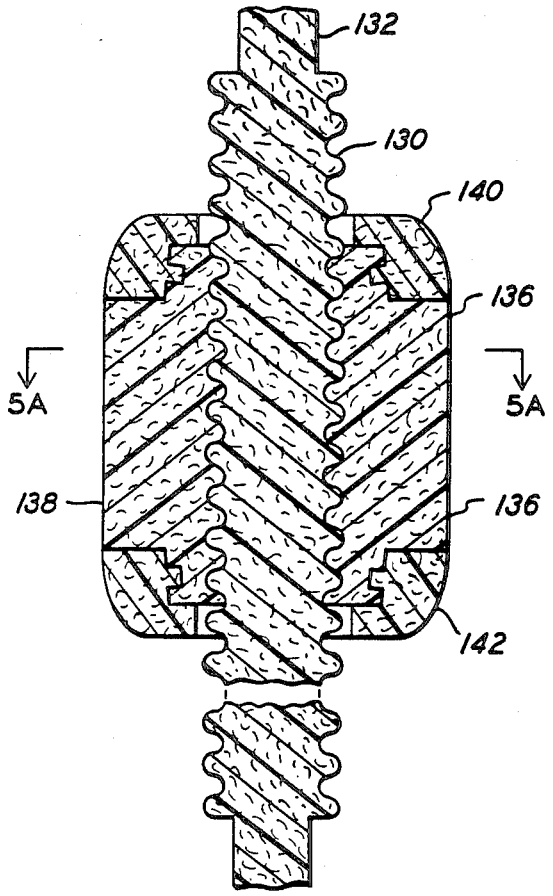
FIGS. 4A and 5A are fragmentary, sectional views, in elevation and along the line 5A—5A in FIG. 4A, respectively, and showing means for assembling the impeller on the shaft in accordance with another embodiment of the invention.
Figure 5A:
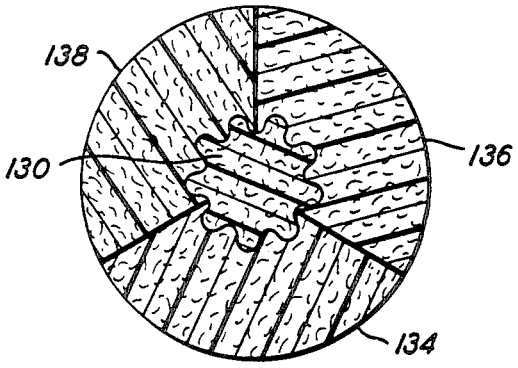

Referring to FIGS. 4A and 5A, there is shown an enbodiment wherein a extremely large number of locations for the impeller on the mounting area 130 of a impeller drive shaft 132 may be provided the hub sections 134, 136, and 138 are held on the mounting area by hub rings 140 and 142, as is the case with the impeller 24 illustrated in FIG. 1 and in the previously discussed figures of the drawings. The interior surface of the hub sections are provided with projections and grooves which undulate, preferably sinusoidally in both the axial and circumferential direction. The exterior surface of the mounting area and the interior surface of the hub sections, thus, appear dimpled. These dimples can interengage in a large number of locations, each separated by one cycle of the undulations. The impeller may then be placed and secured with the hub rings 140 and 142 at a large many positions axial of the shaft. The torque and thrust is uniformly distributed across the undulations without giving rise to overstressed conditions. It will be appreciated that other differently oriented keys and keyways may be used to provide for selective location of the impeller axially on the shaft while opposing both the torque and thrust reaction loads without overstressing the hubs or the mounting area, thereby militating against failure modes in the composite fibrous and plastic material. The use of the cruciform-shaped key and keyways is preferred and provides advantages both in load distribution and ease of fabrication.

The use of a hollow tubular shaft is preferred since it reduces the weight of the impeller system. It is desirable that the medium which is mixed not enter the center of the shaft. To that end it is desirable that a plug 93 be inserted into the lower end of the shaft 20.

Referring to FIG. 11, there is shown another embodiment of the shaft 150 and its mounting area 152. The shaft is preferably a hollow shaft made of composite fibrous and plastic material, like the shaft 20. In order to reduce the weight of the shaft in the mounting area, it is preferably molded with a layer of syntactic foam 154. This is a foam plastic material wherein microballons, either glass or plastic, are contained in the material to define a foam. The syntactic foam is therefore light in weight. The foam layer 154 may be sandwiched between an outer layer 156 of composite fibrous and plastic material. The entire mounting area may be laminated by inserting the syntactic foam layer 154 around the shaft 150 and covering it with glass fiber sheet. The mounting area is then molded in a mold which forms the circumferential, circular thrust keyways 158 and 166 as well as the torque keyways, one of which 163 is illustrated in FIG. 11.

Referring to FIGS. 2, 3, 6, and 7 there is shown a typical proplet 40. The proplets cause the flow into the impeller (the inlet flow) and the flow pumped by the impeller away from the high pressure surfaces thereof, to be essentially axial. Providing such axial flow results in more uniform velocity distribution along the blade and produces greater pumping efficiency. The proplets also reduce vortices at the tip 48 of each impeller blade. The proplets also provide for improved pumping efficiencies (greater flow for applied input power) than is the case when the proplets are not used.

It has been found critical, to providing the advantages of the proplets, that they be mounted above the low pressure side of the blades. It will be seen that the proplets 40 do not project any significant amount below the low pressure side of the blades. The proplets project essentially perpendicularly to the blade axis 54 upwardly above the low pressure side of the blade. The height of the proplet is preferably such that its projection towards the axis of the shaft extends above the leading edge of the blade and also extends beyond the trailing edge. The width of the proplet is also important to obtaining the flow field control and vortex reduction and pumping efficiency increase which is desired. The proplet should be at least as wide (in plan form) as the blade at the attachment point. To this end the proplet extends beyond the trailing edge of the blade at the tip 48 thereof.

It is also critical that the proplet be an air foil having neutral lift. In other words, the camber of the proplet is equal to the curvature thereof at the radius on the impeller where the proplet is located. To this end the mean line 68 is along the circumference of the circle having its center at the blade axis.

The leading edge 160 of the proplet is preferably swept back. The sweep back angle is 55° to the chord of the impeller blade 28 at the tip 48 thereof. The trailing edge 162 is also desirably swept back. The sweep back angle to the projection of the chord is 81°. The angle made by lines extending from the leading and trailing edges of the proplet is desirably 26°. The projected area of the proplet has an average width and height approximately equal to the width of the blade (approximately 10% of the diameter of the impeller). The aspect ratio of the proplet (height along its trailing edge to width along the cord of the blade at the tip 48 may be approximately one to one.

It is a feature of this invention that the impeller diameter may be adjusted. This feature is obtained through the use of the tip portions 62 which are invariant in cross section and twist. The impeller may be tailored to the desired diameter by adjusting its length merely by shortening the tip portion 62. The tip portion is received in a socket 164 at the base 166 of the proplet. The proplet may be bonded in place through the use of pins or a bonding agent, such as epoxy, eurethane, etc.

The proplet like the rest of the impeller system is desirably made of composite fibrous and plastic material. It may be molded around a core of fiberglass sheets surrounded by mats and a corrosion barrier veil by resin transfer molding, preferably using vinyl resin. The proplets may also be made by compression molding of compounds containing fibers and plastic resin.

From the foregoing description it will be apparent that there has been provided improved mixing apparatus which enables a mixing impeller system to be fabricated from composite fibrous and plastic material. Variations in the configuration and the materials used to fabricate the apparatus, within the scope of the invention, will undoubtedly suggest themselves to those skilled in the art. Accordingly, the foregoing description should not be taken as limiting but in an illustrative sense.

We claim:

1. Apparatus for mixing a liquid or liquid suspension medium contained in a vessel which comprises a composite shaft of fibrous and plastic materials, an impeller having a hub and a plurality of blades also a composite of fibrous and plastic material, said blades extending from bases thereon which are disposed at said hub to tips thereof, said blades having a stiffness increasing from the tip to the base for counteracting flexture due to reaction loads of said medium against said blades as said impeller rotates, said hub being disposed on a mounting area of said shaft, and means assembling said hub to said shaft for locking said hub to said shaft against thrust in a direction axially of said shaft and torque in a direction around said shaft due to said reaction loads and while distributing said thrust and torque over said mounting area.

2. The apparatus according to claim 1 wherein said blades have high and low pressure surfaces on opposite sides thereof, proplets of shape to provide neutral lift connected to the tips of said blades, said proplets projecting in a direction axially of said shaft beyond said blades only in the direction toward said low pressure surface and away from said high pressure surfaces.

3. The apparatus according to claim 2 wherein said proplets extend from locations at said tips a distance greater than the thickness of said blades away from the low pressure surface of said blades.

4. The apparatus according to claim 3 wherein said proplets have trailing edges extending above said low pressure surfaces to a location where the projection of the tip of said proplets towards said shaft extends above the leading edge of said blades.

5. The apparatus according to claim 3 wherein said proplets extend beyond the trailing edges of said blades at said tips thereof.

6. The apparatus according to claim 3 wherein said proplets are curved in profile as to be disposed along the circumference of a circle centered at the axis of said shaft.

7. The apparatus according to claim 6 wherein the mean line of said proplets lies along the circumference of a circle of diameter equal approximately to the diameter of said impeller.

8. The apparatus according to claim 3 wherein the leading edges of said proplets are swept back.

9. The apparatus according to claim 8 wherein the aspect ratio of the height to width of said proplets is about 1 to 1.

10. The apparatus according to claim 8 wherein the angle made by said leading edges to the chords of the blades at said tips of said blades is about 55°.

11. The apparatus according to claim 8 wherein the angle made by the trailing edges of said proplets to said chords is about 81°.

12. The apparatus according to claim 2 wherein said proplets are a composite of fibrous and plastic material.

13. The apparatus according to claim 2 wherein said blades and proplets are both air foils, said blades providing lift in the axial direction from said high to said low pressure surfaces thereof and said proplets providing neutral lift.

14. The apparatus according to claim 1 wherein said mounting area has a larger diameter than said shaft and extends axially over a distance at least as long as the axial length of said hub.

15. The apparatus according to claim 14 wherein said assembling means includes means on said mounting area for enabling said hub to be assembled to said mounting area locked against said thrust and torque at a plurality of locations spaced from each other in a direction along the axis of said shaft.

16. The apparatus according to claim 14 wherein said enabling means comprises one torque opposing area for each blade on the surface of said mounting area and extending in the direction of said axis, and at least one thrust opposing area on the surface of said mounting area and extending circumferentially thereabout.

17. The apparatus according to claim 14 wherein said thrust and torque opposing areas intersect each other and form a plurality of cruciforms which are circumferentially spaced from each other.

18. The apparatus according to claim 1 wherein said blades and hub are integral structures, the interior surface of said hub and the exterior surface of said mounting area having said assembling means and comprising a plurality of interlocking thrust opposing keys and keyways spaced from each other along said axis and at least one torque opposing key for each blade and a keyway, one on said mounting area and the other on said hub, which extends along said axis.

19. The apparatus according to claim 18 wherein said ones of said keys or keyways on said mounting area intersect to form a plurality of circumferentially spaced cruciforms.

20. The apparatus according to claim 18 wherein said blades each have a blade axis extending radially therethrough approximately along the locii of the reaction load on said blade, a plurality of torque opposing keys and keyways on said hub and mounting area, and each disposed to intersect the projection of a different one of the blade axes.

21. The apparatus according to claim 20 wherein the thrust opposing key or keyway on said hub is disposed in the direction on the side of said blade axes opposite to the surface of the blade to which said thrust load is principally applied 22. The apparatus according to claim 21 wherein said blade is an airfoil and said surface to which said thrust is applied is the high pressure surface of said blade.

23. The apparatus according to claim 21 wherein said thrust opposing key or keyway on said hub is disposed between the end of said hub which is closest to the surface of said blades opposite to the surface to which said thrust load is principally applied.

24. The apparatus according to claim 20 wherein said keys and keyways are semicircular in cross section.

25. The apparatus according to claim 1 wherein said shaft is tubular.

26. The apparatus according to claim 25 wherein said mounting area is defined by a layer of syntactic foam, an outer layer of composite fibrous and plastic material, said foam layer being disposed between said shaft and said outer layer and laminated therewith.

27. The apparatus according to claim 26 wherein said hub has a plurality of sections each being contained in an adjacent sector of a circle centered at the axis of said shaft, said sections at the opposite ends thereof each having a thread, a pair of hub rings having a plurality of threads equal in number to said plurality of hub sections for engaging said threads of said sections and assembling said sections on said mounting area, said hub rings and threads being included in said assembling means, said hub rings or the surfaces of said ends of said sections engageable therewith being tapered.

28. The apparatus according to claim 27 wherein said hub rings are of composite fibrous and plastic material.

29. The apparatus according to claim 1 wherein said blades are each airfoils having camber and twist, the thickness of said blades decreasing over a substantial portion of the radial length thereof in the direction towards their tips, the width, twist and cross-sectional shape of said blades being invariant over a portion of said radial length extending up to the end of said substantial portion from the tip toward the base to enable said blades to be adjusted in diameter by changing said length of said tip portion.

30. The apparatus according to claim 29 wherein the width of said blades decreases over a substantial portion of said radial length thereof in a direction toward said tip, said width being invariant over said tip portion.

31. The apparatus according to claim 30 wherein the twist of said blades as measured between the chord and a plane perpendicular to the shaft axis intersecting said chord decreases in a direction toward said tip, said twist being constant in said tip portion.

32. The apparatus according to claim 29 wherein said tip portion is disposed along the radial length of said blade from said tip inwardly to said shaft until a point along said radial length from the axis of said shaft determined by the equation X/D equals approximately 0.45, where X is the radial location of said point from the shaft center line and D is the diameter of said impeller.

33. The apparatus according to claim 32 wherein the thickness, twist and width of each of said blades is invariant over a portion thereof extending from the base toward said tip.

34. The apparatus according to claim 33 wherein said invariant portion extending from said base extends to a point along said base along the radial length of said blade from said base defined by the equation X/D equals approximately 0.15, where X is the radial location of said point from the shaft center line and D is the diameter of said impeller.

35. The apparaus according to claim 34 wherein said points are measured along the radial line which is the blade axis and is approximately at the locii of the reaction load on said blades, said substantial portion being disposed between the point $X_1$ defined by $X_1/D$ which is approximately equal to 0.45 and the point $X_2$ defined by $X_2/D$ equal approximately to 0.15.

36. The apparatus according to claim 35 wherein said blade axis is at 40% of the chord length from the leading edge of said blade and 60% of the chord length from the trailing edge of said blade.

37. The apparatus according to claim 33 wherein each of said blades is swept back along its leading edge except in said invariant portion at said base and swept forward along its trailing edge except at said invariant base portion and said tip portion.

38. The apparatus according to claim 35 wherein said thickness varies over said substantial portion of said blade by a percentage equal approximately to 2% where said percentage is equal to $T/D \times 100$, where T is the thickness and D is the impeller diameter.

39. The apparatus according to claim 38 wherein said width varies across said substantial portion by a percentage approximately 6%, where said percentage is equal to $C/D \times 100$, where C is the chord length and D is the impeller diameter.

40. The apparatus according to claim 39 wherein said twist measured between said chord and a plane perpendicular to said shaft axis intersecting said chord varies approximately 14° across said substantial portion.

41. The apparatus according to claim 32 further comprising a proplet attached to the end of said tip portions of the adjusted length of each blade, said proplets extending in their entirety above the low pressure surfaces of said blades.

42. The apparatus according to claim 1 wherein said hub has a plurality of sections which have threads on the opposite ends thereof, hub rings having threads on the inside surface thereof complementary to said hub section threads, said sections being disposed around said shaft to define threaded annular regions where said opposite ends join each other, and said annular regions or said inside surfaces of said hub rings being tapered to permit said rings to clamp said sections on said shaft thereby providing said assembling means.

43. Mixing apparatus for liquid or liquid suspension mediums comprising an impeller having a plurality of blades having high and low pressure surfaces on opposite sides thereof, proplets of air foil profile with neutral lift attached to the tips of said blades and extending only and entirely above said low pressure surfaces, and further comprising means for attaching said proplets to said blades at selected distances radially along said blades to provide impellers of selected diameter.

44. In mixing apparatus having an impeller with blades, a hub, and a shaft, apparatus for mounting said impeller on said shaft which comprises at least one thrust opposing key and one thrust opposing keyway, one of said thrust key and keyway extending circumferentially around the interior surface of said hub in a plane perpendiculer to the axis of said shaft, the other of said thrust key and keyway extending circumferentially around the exterior surface of said shaft in an area of said shaft for mounting said impeller, at least one torque opposing key and one torque opposing keyway, one of said torque key and keyway extending axially of said shaft along the interior surface of said hub, and the other of said torque key and keyway extending axially of said shaft in said mounting area.

45. The apparatus according to claim 44 wherein said thrust key and torque key intersect to define a cruciform, and said thrust keyway and torque keyway also intersect to form a corresponding cruciform.

46. The apparatus according to claim 44 wherein a plurality of said thrust keys and keyways are provided which are spaced axially of each other and intersect said torque keys and keyways at said plurality of axially spaced locations to enable location of said impeller at selected positions axially of said shaft.

47. The apparatus according to claim 44 wherein said hub has a plurality of sections each contained in an adjacent sector of a circle around said shaft, a different one of said blades being connected to each of said hub sections, and hub rings on opposite ends of said hubs for assembling said sections together on said shaft.

48. The apparatus according to claim 47 wherein said plurality of thrust keys and keyways are disposed adjacent to each other, said torque keys and keyways are also disposed adjacent to each other to define undulations in said shaft exterior surface and in said hub interior surface which can interlock with each other in a multiplicity of positions axially and circumferentially of said shaft.

49. The apparatus according to claim 44 wherein said blades each have a blade axis extending radially at which the locii of the reaction loads thereon are approximately disposed, said one of said torque keys and keyways on the interior surface of said hub in each of said sections extending perpendicularly to said blade axis of said section and intersecting the projection of said blade axis toward said shaft.

50. The apparatus according to claim 49 wherein said blades have high pressure and low pressure surfaces on opposite sides thereof, said ones of said thrust key and keyway on said internal surface of said hub being disposed away from the intersection of said blade axis with said interior surface in the direction of said low pressure surface.

51. The apparatus according to claim 47 wherein said one of said thrust key and keyway on said internal surface of said hub is disposed between said low pressure surface and the end of said hub nearest to said low pressure surface.

52. The apparatus according to claim 51 wherein said blade axis of each blade is located approximately 40% of the length of the chord thereof away from the leading edge of said blade.

53. The apparatus according to claim 47 wherein each section has a thread on each of its opposite ends, and said hub rings have a plurality of mating threads equal in number to the plurality of said sections, said hub rings being screwed with their threads on the threads of the opposite ends of said sections when assembled on said shaft, at least one of the engaging surfaces of said hub rings and the ends of said sections being tapered.

54. The apparatus according to claim 44 wherein said one of said keys and keyways are and are disposed on the internal surface of said hub, and the other of said keys and keyways are the keyways which are disposed on the exterior surface of said shaft mounting area.

55. The apparatus according to claim 44 wherein said impeller consists of composite fibrous and plastic material, and said keys and keyways are semicircular in cross section.

56. An impeller for mixing liquid or liquid suspension mediums in a vessel which comprises a plurality of blades of composite fibrous and plastic material, each having a base and a tip at its opposite ends, each blade being an airfoil with camber and twist, the thickness of said blades decreasing over a substantial portion of the radial length thereof, the width and cross-sectional shape of said blades being invariant over a portion of said radial length extending a distance up to the end of said substantial portion from the tip of each blade to enable said blades and impeller to be adjusted in diameter by reducing the length of said tip portion.

57. The apparatus according to claim 56 wherein the width of said blades decreases over a substantial portion of said radial length thereof in a direction toward said tip, said width being invariant over said tip portion.

58. The apparatus according to claim 57 wherein the chord angle of said blades as measured between the chord and a plane perpendicular to the shaft axis intersecting said chord decreases in a direction toward said tip, said chord angle being constant in said tip portion.

59. The apparatus according to claim 56 wherein said tip portion is disposed along the radial length of said blade from said tip inwardly to said shaft until a point along said radial length from the axis of said shaft determined by the equation X/D equals approximately 0.45, where X is the location of said point and D is the diameter of said impeller.

60. The apparatus according to claim 59 wherein the chord angle and width of each of said blades is invariant over a portion thereof extending from the base toward, said tip.

61. The apparatus according to claim 60 wherein said invariant portion extending from said base extends to a point along said base along the radial length of said blade from said base defined by the equation X/D equals approximately 0.15, where X is the location of said point and D is the diameter of said impeller.

62. The apparatus according to claim 61 wherein said point is measured along the radial line which is the blade axis and is approximately at the locii of the reaction load on said blades, said substantial portion being disposed between the point X, defined by $X_1/D$ which is approximately equal to 0.45 and the point $X_2$ defined by $X_2/D$ equal approximately to 0.15.

63. The apparatus according to claim 62 wherein said blade axis is at 40% of the chord from the leading edge of said blade and 60% of the chord length from the trailing edge of said blade.

64. The apparatus according to claim 60 wherein each of said blades is swept back along its leading edge except in said invariant portion at said base and swept forward along its trailing edge except at said invariant base portion and said tip portion.

65. The apparatus according to claim 62 wherein said thickness varies over said substantial portion of said blade by a percentage equal approximately to two and one half percent where said percentage is equal to $T/D \times 100$, where T is the thickness and D is the impeller diameter.

66. The apparatus according to claim 65, wherein said width varies across said substantial portion by a percentage approximately 6 percent, where said percentage is equal to $C/D \times 100$, where C is the chord length and D is the impeller diameter.

67. The apparatus according to claim 66 wherein said twist measured between said chord and a plane perpendicular to said shaft axis intersecting said chord varies approximately 13° across said substantial portion.

68. The apparatus according to claim 59 further comprising a proplet attached to the end of said tip portions of the adjusted length of each blade, said proplets extending in their entirety above the pressure surfaces of said blades.

* * * * *